US006411722B1

(12) United States Patent
Wolf

(10) Patent No.: US 6,411,722 B1
(45) Date of Patent: Jun. 25, 2002

(54) EARPHONE FOR AN RF TRANSMITTING DEVICE

(76) Inventor: Dan Wolf, Habsor 1, Herzeliya 46328 (IL)

( * ) Notice: Subject to any disclaimer, the term of this patent is extended or adjusted under 35 U.S.C. 154(b) by 0 days.

(21) Appl. No.: 09/569,040

(22) Filed: May 11, 2000

(51) Int. Cl.[7] ..... H04R 25/00

(52) U.S. Cl. ..... 381/371; 381/370; 381/380; 381/382

(58) Field of Search ..... 381/370, 371, 381/374, 380, 381, 382, 328, 338, FOR 133, FOR 149; 181/129, 130, 135; 455/575, 300, 301; 361/814, 816

(56) References Cited

U.S. PATENT DOCUMENTS

| | | | | | |
|---|---|---|---|---|---|
| 447,858 | A | | 3/1891 | Wright et al. | |
| 493,245 | A | | 3/1893 | Brown | |
| 1,296,763 | A | | 3/1919 | Cherry | |
| 1,581,700 | A | | 4/1926 | Summer | |
| 1,624,144 | A | | 4/1927 | Mathieu | |
| 2,363,175 | A | * | 11/1944 | Grossman | 381/380 |
| 2,506,981 | A | | 5/1946 | Weaver et al. | 179/107 |
| 2,521,414 | A | | 9/1950 | Schier | 181/23 |
| 2,545,731 | A | * | 3/1951 | French | 381/382 |
| 2,573,132 | A | | 10/1951 | French | 181/23 |
| 2,584,402 | A | | 2/1952 | Volkmann | 181/23 |
| 2,586,644 | A | * | 2/1952 | Gilbert | 381/382 |
| 2,739,660 | A | | 3/1956 | French | 181/23 |
| 2,939,923 | A | | 6/1960 | Henderson | 179/182 |
| 2,964,596 | A | | 12/1960 | Christensen | 179/107 |
| 3,080,011 | A | | 3/1963 | Henderson | 181/23 |
| 3,169,600 | A | | 2/1965 | Thomas | 181/24 |
| 3,324,253 | A | | 6/1967 | Uemura et al. | 179/115 |
| 3,830,334 | A | | 8/1974 | Costa | 181/31 B |
| 3,934,100 | A | | 1/1976 | Harada | |
| 4,677,679 | A | * | 6/1987 | Killion | 381/382 |
| 4,736,435 | A | * | 4/1988 | Yokoyama et al. | 381/380 |
| 4,864,610 | A | | 9/1989 | Stevens | 379/431 |
| 5,048,092 | A | * | 9/1991 | Yamaghishi et al. | 381/380 |
| 5,396,563 | A | | 3/1995 | Yoshimi | |
| 5,564,085 | A | | 10/1996 | Chen et al. | 455/117 |
| 5,631,965 | A | | 5/1997 | Chang et al. | |
| 5,887,070 | A | * | 3/1999 | Iseberg et al. | 381/380 |
| 6,084,976 | A | * | 7/2000 | Lin | 381/380 |
| 6,094,494 | A | | 7/2000 | Haroldson | 381/328 |

FOREIGN PATENT DOCUMENTS

| | | |
|---|---|---|
| DE | 196 09 791 | 7/1997 |
| GB | 2 068 681 | 8/1981 |
| GB | 2316263 | 2/1998 |
| GB | 2 355 129 | 4/2001 |

* cited by examiner

*Primary Examiner*—Huyen Le
(74) *Attorney, Agent, or Firm*—Nath & Associates PLLC; Gary M. Nath; Marvin C. Berkowitz

(57) ABSTRACT

An acoustic earphone for transmitting sound from a transducer sound source, the earphone comprising a sound transmitting tube portion extending between an ear tip member for engaging the external ear canal of a user, and a sound receiving end fitted to said sound source. A faraday cage is fitted over the sound source.

11 Claims, 2 Drawing Sheets

EARPHONE FOR AN RF TRANSMITTING DEVICE

FIELD OF THE INVENTION

The present invention relates to an improved earphone for use with communication equipment emitting radio frequency (RF) radiation, such as cellular telephones or others, in which hazardous risks are reduced.

BACKGROUND OF THE INVENTION

In recent years there has been an explosion in the extent of use of cellular telephones. Particularly popular are such telephones, which are small, hand held devices comprising a mouthpiece and an ear piece and including within it the entire communication circuitry. A major problem which has been identified in recent years, associated with the use of such device, is the RF radiation emitted thereby, which is believed to cause an accumulating hazardous effect, particularly on brain tissue, which is proximal to the RF-emitting antenna.

The RF radiation can in principle be shielded by various means, but these are heavy, cumbersome and thus not user friendly. Another drawback of such shielding arrangements is that they can interfere with the quality of reception and transmission.

The intensity of the radiation diminishes as a square function of the distance from the source of radiation, i.e. from the antenna. Accordingly, devices have been suggested which may be attached to the ear piece to increase distance between the antenna and the user's head. In order not to affect the hearing ability of the sound emitted from the ear piece, it has also been suggested to use a spacer with walls defining a sound channel for sound transmission from the ear piece to the user's ear. An example of such a device is that described in German Utility Model DE 97-U2-00243.

Other devices which provide a permanent sound channel between the ear piece and the user's ear, i.e. not having collapsible walls, are also known, such as that described in U.S. Pat. No. 5,564,085.

It has recently become common to use personal ear pieces detachably connectable to the cellular telephones which are equipped with an integral microphone fitted on the cord connecting the ear piece to the cellular phone. Such ear pieces provide improved acoustics and isolation from surrounding noise and for a while it has been believed that the significantly increased distance of the antenna of a cellular phone from the user's head eliminates the hazardous affect of radiation. However, some recent researchers have shown to the contrary, namely that the ear piece plugged into the user's ear emits radiation at rates which are significantly higher than those transmitted from the antenna and which are extremely hazardous.

It is thus an object of the present invention to provide an improved ear piece in order to reduce or eliminate the radiation from the user's head. Iot is a specific object of the invention to provide an earphone which can be attached to an ear piece of such a communication device to form a sound channel between the ear piece and the users ear.

SUMMARY OF THE INVENTION

The invention is concerned with an acoustic earphone for retaining an earphone connected to a radio transmitting device at an extended distance from the user's head whereby acoustic communication is facilitated via an acoustic tube.

In accordance with the present invention there is provided an acoustic earphone for transmitting sound from a transducer sound source, the earphone comprising a sound transmitting tube portion extending between an ear tip member for engaging the external ear canal of a user, and a sound receiving end fitted to said sound source.

According to one embodiment of the invention, the sound receiving end is integrally formed or fixedly attached to the sound source. According to another embodiment, the sound receiving end is removably attached to the sound source which, by a typical example of the invention is an earphone connected via a wire to the mobile cellular phone.

By still another embodiment of the invention, either one or both of the sound source, namely earphone, and the sound receiving end is fitted with a Faraday cage providing an electrostatic shield, preventing or reducing radiation from the earphone.

Preferably, at an operative state, the sound transmitting tube defines a minimal distance between the earphone and the user's ear of at least about 3 cm By another aspect of the present invention, the earphone is adapted for placing adjacent a user's ear and where the housing thereof is received win a Faraday cage, typically made of a mesh wire, for reducing or eliminating radiation of a magnetic wave.

BRIEF DESCRIPTION OF THE DRAWINGS

In order to better understand the invention and to see how it may be carried out in practice, some embodiments will now be described, by way of non-limiting examples only, with reference to the accompanying drawings in which.

DETAILED DESCRIPTION OF SPECIFIC EMBODIMENTS

Figure 1:
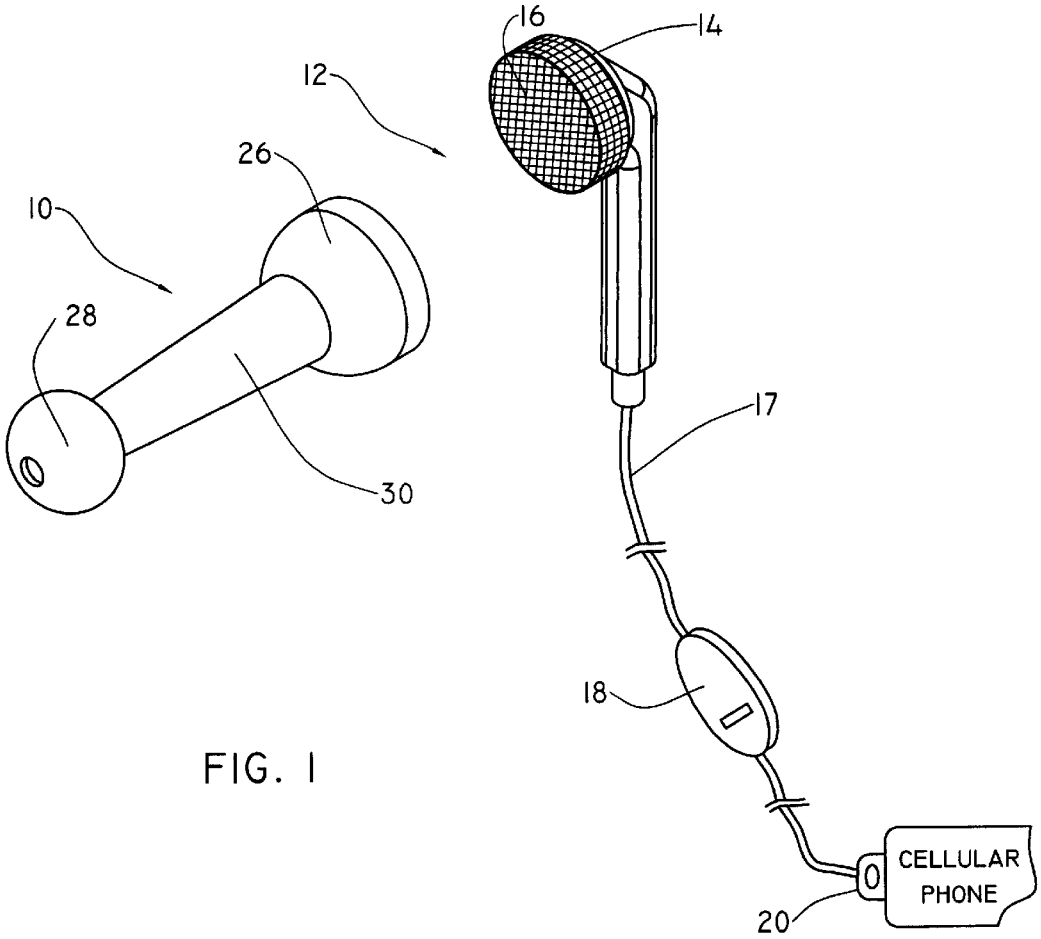
FIG. 1 is an exploded view of an acoustic earphone in accordance with the present invention detached from an earphone connectable to a communication device, the earphone comprising a Faraday cage.
Figure 2:
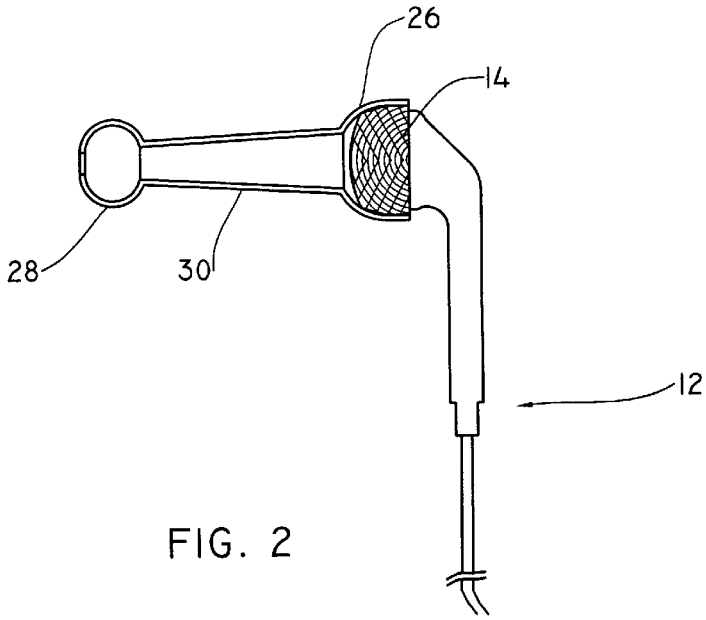
FIG. 2 illustrates the components of FIG. 1 in their assembled position.

Attention is first directed to FIGS. 1 and 2 illustrating an acoustic earphone in accordance with the present invention, generally designated 10, and an earphone generally designated 12 of the type which is detachably connectable to a cellular phone. Earphone 12 comprises an ear tip 14 with a cylindrical housing, the ear tip being formed with a Faraday cage 16 for reducing or eliminating radiation emitted from the ear tip. Extending from the ear tip there is a cord 17 fitted with a microphone 18 and a plug 20 for detachably connecting to a suitable socket of a cellular phone (not shown). The earphone 12 is of standard structure as known per se, the addition being the provision of the Faraday cage 16 typically, a fine wire mesh.

The acoustic earphone 10 comprises a sound receiving end 26 and an ear tip 28, with an acoustic, sound transmitting tube portion 30 extending therebetween.

Ear tip 28 is anatomically designed for engaging the external ear canal of a user and the sound receiving end 26 is fitted with a receptacle for snugly accommodating the housing 14 of earphone 12, as can be seen in the assembled position of FIG. 2.

The length of the sound transmitting tube portion 30 ensures that the earphone 12 is retained at a distance of at least 3 cm from the user's head, and preferably more than 4 cm.

It is noted that the configuration of earphone 12 seen in FIG. 1 is in itself a suitable solution for eliminating or reducing magnetic radiation, as the housing 14 is received within the Faraday cage 16.

Figure 3:
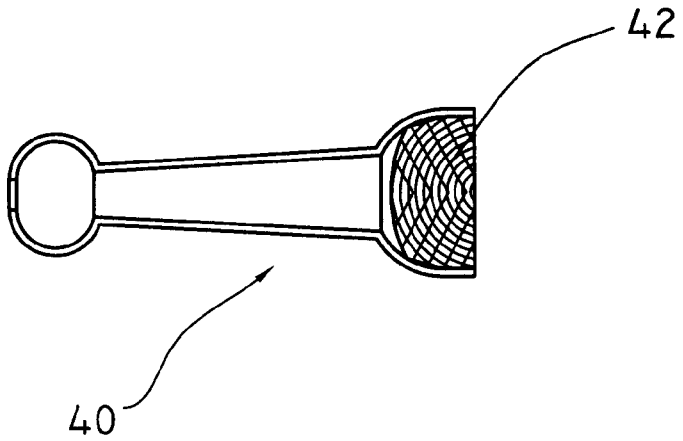
FIG. 3 illustrates an acoustic earphone in accordance with the present invention, integrally fitted with a Faraday cage.

Further attention is now directed to the embodiment of FIG. 3 which is principally similar to the embodiment seen in FIGS. 1 and 2 wherein the acoustic earphone designated 40 has the same general appearance as earphone 10 in FIGS. 1 and 2 with the addition of a Faraday cage 42, integrally formed at the sound receiving end in the form of a fine wire mesh embedded in the receptacle portion thereof. This device is suitable for use with existing earphones and may be used as an add-on device.

Figure 4:
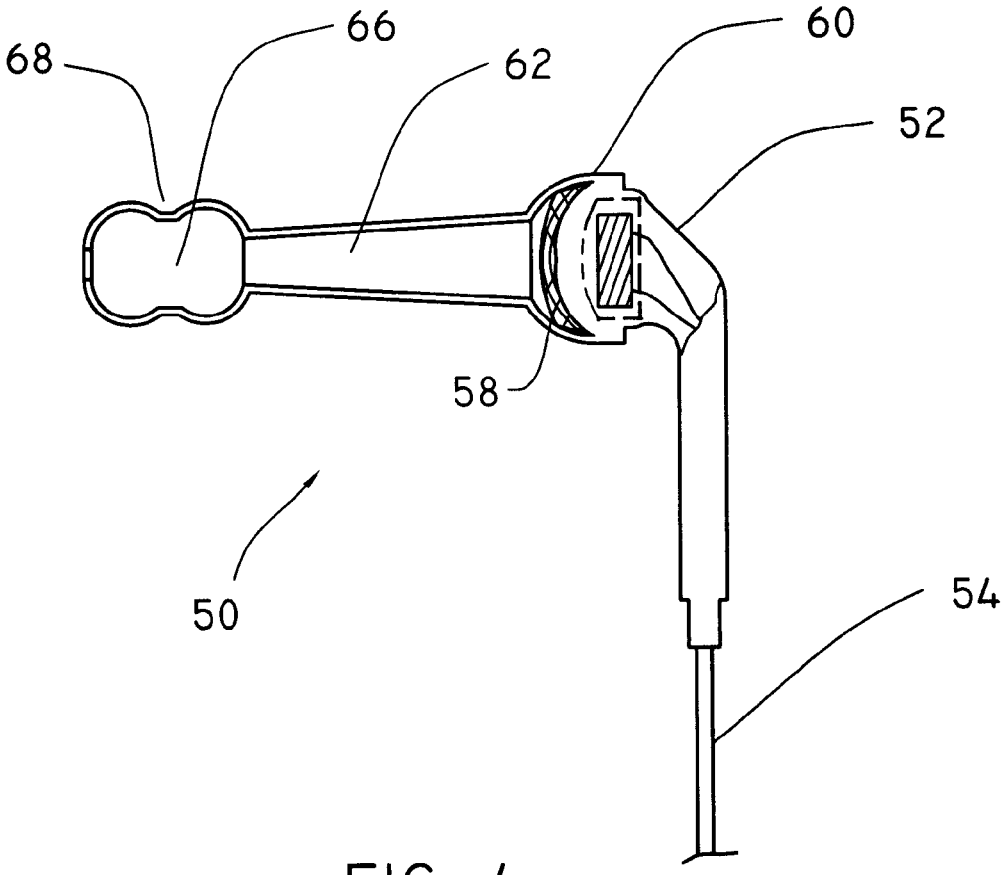
FIG. 4 illustrates an acoustic earphone integrally fitted with an earphone connectable to a cellular phone.

The embodiment of FIG. 4 discloses an acoustic earphone 50 integrally fitted with an earphone 52, connectable by means of cord 54 to a cellular phone (not shown). In accordance with the embodiment of FIG. 4 there is provided a Faraday cage 58 which is integrally fitted at the sound receiving end 60 of the acoustic earphone 50.

Extending from the sound receiving end 60 there is a sound transmitting tube 62 terminating at an ear tip 66 which is fitted with a resilient tip 68 providing improved acoustic isolation from environmental noise and for improved gap within the external ear canal of the user.

While there have been disclosed some embodiments of the invention, it is to be understood that many changes may be made therein without departing from the spirit of the invention, thus the assembly may be an add-on type article for use with conventional earphones or, it may be integrated with an earphone. Furthermore, the ear tip member may be of any suitable design for comfortably and efficiently engaging the users external ear canal for providing comfort acoustic isolation and self retaining of the acoustic earphone within the user's ear. However, if required, a suitable auricle-attachment member may be provided for retaining the acoustic earphone to the user's ear.

What is claimed is:

1. An acoustic earphone assembly for transmitting sound from a transducer sound source, constituted by an earphone connected by wires to a cellular phone provided with a transmitter that radiates radio-frequency energy, said assembly comprising:

a sound transmitting tube extending between an ear tip member for engaging the external ear canal of a user of the cellular phone, and a sound receiving end fitted to said sound source, and a Faraday cage enveloping the earphone to interpose a radio-frequency protective shield between the earphone and the user.

2. An acoustic earphone according to claim 1, wherein at use the sound source is retained at a distance from the user's head.

3. An acoustic earphone according to claim 2, wherein the distance is at least about 4 cm.

4. An acoustic earphone according to claim 2, wherein the length of the sound transmitting tube portion is at least about 4 cm.

5. An acoustic earphone according to claim 1, wherein the ear tip is fitted for self retaining in the external ear canal of the user.

6. An acoustic earphone according to claim 1, wherein the ear tip provides acoustic isolation from environmental noise.

7. An acoustic earphone according to claim 1, wherein the sound receiving end is integrally formed or fixedly attached to the sound source.

8. An acoustic earphone according to claim 1, wherein the sound receiving end is removably attached to the sound source.

9. An acoustic earphone according to claim 8, wherein the sound receiving end is fitted with a receptacle portion for snugly receiving the sound source.

10. An acoustic earphone according to claim 1, wherein the ear tip comprises a deformable portion for adapting to the shape of the user's ear.

11. An acoustic earphone according to claim 1, wherein there is further provided an auricle-attachment member for retaining the ear tip with the external ear canal of the user.

* * * * *

UNITED STATES PATENT AND TRADEMARK OFFICE

CERTIFICATE OF CORRECTION

PATENT NO. : 6,411,722 B1
DATED : June 25, 2002
INVENTOR(S) : Dan Wolf

It is certified that error appears in the above-identified patent and that said Letters Patent is hereby corrected as shown below:

Column 4,
Line 41, change “with” to -- within --.

Signed and Sealed this

Thirtieth Day of July, 2002

*Attest:*

*Attesting Officer*

JAMES E. ROGAN
*Director of the United States Patent and Trademark Office*